US011118777B2

(12) United States Patent
Wu et al.

(10) Patent No.: US 11,118,777 B2
(45) Date of Patent: Sep. 14, 2021

(54) LIGHTING LAMP

(71) Applicants: OPPLE LIGHTING CO., LTD., Shanghai (CN); SUZHOU OPPLE LIGHTING CO., LTD., Suzhou (CN)

(72) Inventors: Wangbosheng Wu, Shanghai (CN); Xianglan Li, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/854,558

(22) Filed: Apr. 21, 2020

(65) Prior Publication Data

US 2020/0248900 A1 Aug. 6, 2020

Related U.S. Application Data

(63) Continuation of application No. PCT/CN2018/109887, filed on Oct. 11, 2018.

(51) Int. Cl.
*F21V 29/75* (2015.01)
*F21V 29/83* (2015.01)
*F21Y 107/40* (2016.01)

(52) U.S. Cl.
CPC ..... *F21V 29/75* (2015.01); *F21V 29/83* (2015.01); *F21Y 2107/40* (2016.08)

(58) Field of Classification Search
CPC ..... F21V 29/75; F21V 29/83; F21V 29/763; F21K 9/237; F21Y 2107/40; F21Y 2105/18; F21Y 2107/30; F21Y 2113/20; F21Y 2115/10
See application file for complete search history.

(56) References Cited

U.S. PATENT DOCUMENTS 7,434,964 B1 * 10/2008 Zheng ..... F21K 9/232 362/294
7,513,653 B1 * 4/2009 Liu ..... F21V 29/004 362/218
8,436,517 B2 * 5/2013 Oki ..... F21V 29/713 313/46

(Continued)

FOREIGN PATENT DOCUMENTS

CN 104075165 A 10/2014
CN 204114655 U 1/2015

(Continued)

OTHER PUBLICATIONS

International Search Report (including English translation) and Written Opinion issued in PCT/CN2018/109887, dated Jan. 18, 2019, 10 pages.

*Primary Examiner* — Peggy A Neils
(74) *Attorney, Agent, or Firm* — Arch & Lake LLP

(57) ABSTRACT

The present disclosure discloses a lighting lamp, and the lighting lamp includes an interface base; a radiator, a lower end of the radiator being connected to the interface base; a side cover, disposed on a side of the radiator and located on an outer periphery of the radiator; a top cover, disposed on an upper end of the radiator; and a light source assembly, including a side light source installed between the radiator and the side cover and a top light source installed between the radiator and the top cover.

20 Claims, 13 Drawing Sheets

(56) References Cited

U.S. PATENT DOCUMENTS

| | | | | |
|---|---|---|---|---|
| 8,680,754 | B2 * | 3/2014 | Premysler | F21V 29/80 313/46 |
| 9,062,875 | B2 * | 6/2015 | Neal | F21V 31/005 |
| 9,243,758 | B2 * | 1/2016 | Pickard | F21V 29/74 |
| 2014/0240990 | A1 * | 8/2014 | Bae | F21K 9/232 362/294 |
| 2019/0032860 | A1 * | 1/2019 | Wen | F21V 29/74 |

FOREIGN PATENT DOCUMENTS

| | | | |
|---|---|---|---|
| CN | 205191258 | U | 4/2016 |
| CN | 106195718 | A | 12/2016 |
| CN | 207334664 | U | 5/2018 |
| JP | 2016015329 | A | 1/2016 |

* cited by examiner

LIGHTING LAMP

CROSS-REFERENCE TO RELATED APPLICATIONS

This application is based upon and claims the priority of PCT patent application No. PCT/CN2018/109887 filed on Oct. 11, 2018 which claims the priority of Chinese Patent Application No. 201721375896.7 filed on Oct. 24, 2017, the entire content of all of which is hereby incorporated by reference herein for all purposes.

TECHNICAL FIELD

The present disclosure relates to the technical field of lighting lamps, and particularly relates to a lighting lamp with an enlarged light emitting surface.

BACKGROUND

In a field of lighting lamps, how to improve a heat dissipation effect and a luminous efficiency of a lighting lamp under the premise that the lighting lamp has a small volume is a research trend.

SUMMARY

Examples of the present disclosure provide a lighting lamp and a method of manufacturing a lighting lamp.

According to one aspect, the present disclosure provides a lighting lamp. The lighting lamp may include: an interface base; a radiator, a lower end of the radiator that may be connected to the interface base; a side cover that may be disposed on a side of the radiator and may be located on an outer periphery of the radiator; a top cover that may be disposed on an upper end of the radiator; and a light source assembly that may include a side light source installed between the radiator and the side cover and a top light source installed between the radiator and the top cover.

According another aspect, the present disclosure provides a method of manufacturing a lighting lamp. The method may include: providing an interface base; connecting the interface base to a lower end of a radiator; disposing a side cover on a side of the radiator where the side cover may be located on an outer periphery of the radiator; disposing a top cover on an upper end of the radiator; and providing a light source assembly that may include a side light source installed between the radiator and the side cover, and a top light source installed between the radiator and the top cover.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and constitute a part of the present disclosure. The examples of the present disclosure and the descriptions thereof are used to explain the present disclosure, and do not constitute an improper limitation on the present disclosure. In the drawings.

DETAILED DESCRIPTION

In order to make objects, technical details and advantages of the examples of the present disclosure apparent, the technical solutions of the examples will be described in a clearly and fully understandable way in connection with the drawings related to the examples of the disclosure. Apparently, the described examples are just a part but not all of the examples of the present disclosure. Based on the described examples herein, those skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if"

may be understood to mean "when" or "upon" or "in response to" depending on the context.

Figure 1:
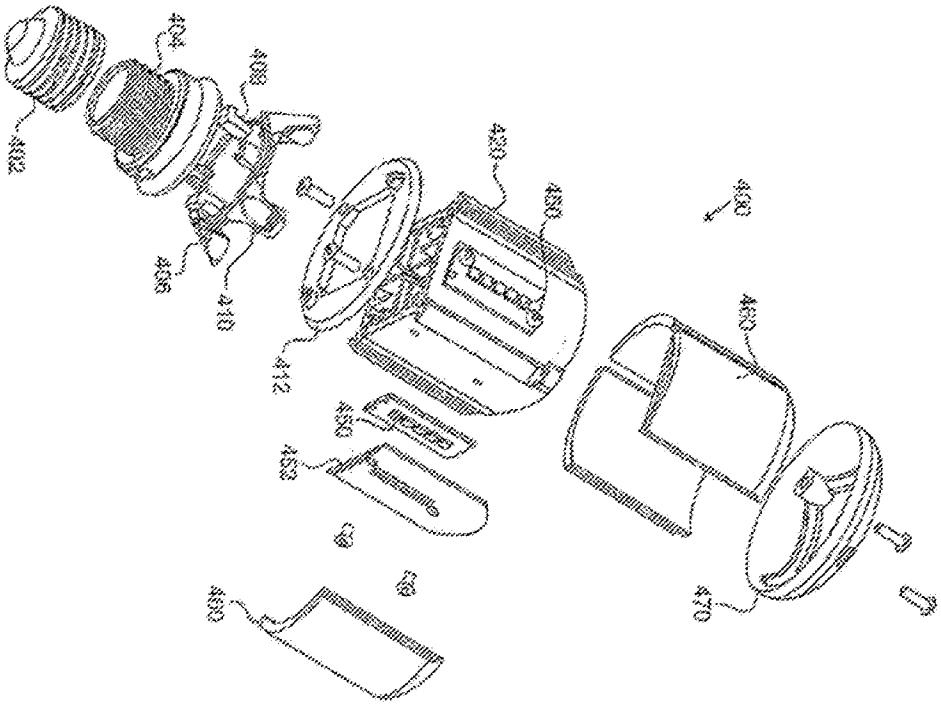
FIG. 1 (Prior Art)
FIG. 1 is a schematic structural diagram of a lighting lamp.

In a radiator and a lamp including the radiator, as shown in FIG. 1, the lamp includes a threaded sleeve 402 that cooperates with a lower equipment housing 404. The lower equipment housing 404 accommodates a driving circuit that converts standard power into a voltage and a current that are suitable for driving a solid-state light source. The lower equipment housing 404 also supports a lower bearing 406 with four leg frames 408, the leg frames 408 just fit into the lower equipment housing 404 and can be snapped into a cutting portion or a locking groove, or can be interlocked with the cutting portion or the locking groove. Four brackets and spacer arms 410 are also provided on an upper portion of the lower bearing 406, and the four brackets and spacer arms 410 support a lower base 412 at the upper portion of the lower bearing 406 and are spaced apart from the lower equipment housing 404. The spacing between the four brackets and spacer arms 410 and the lower equipment housing 404 is conducive to allowing free airflow and helps to provide thermal isolation between the driving circuit and a LED. The upper portion of the lamp 400 includes a radiator 420, four LED boards 450, a reflector board 452, a side lens 460, and a top lens 470. The radiator 420 includes a dissipation region side wall defining a heat dissipation chamber, and the heat dissipation chamber extends between an air inlet and an air outlet (a top opening does not include a region for disposing a heat dissipation sheet).

However, in this lamp, the LED 450 is provided only on the side of the lamp, so that the light emitting surface of the lamp is small.

In FIG. 2-FIG. 13, the numbers may refer to the following terms: Interface base—1; radiator—2; side cover—3; top cover—4; light source assembly—5; base cover—6; power source—7; adapter plate—8; screw—9; fixing hole—21; heat dissipation sheet—22; heat dissipation chamber—23; corner—24; bent portion—31; snap-fit component—41; air outlet—42; side light source—51; top light source—52; air inlet—61; protrusion platform—62; adapter plate welding surface—81; arc-shaped heat dissipation plate—221; heat conduction plate—222; card plate—223; slot—224.

Figure 2:
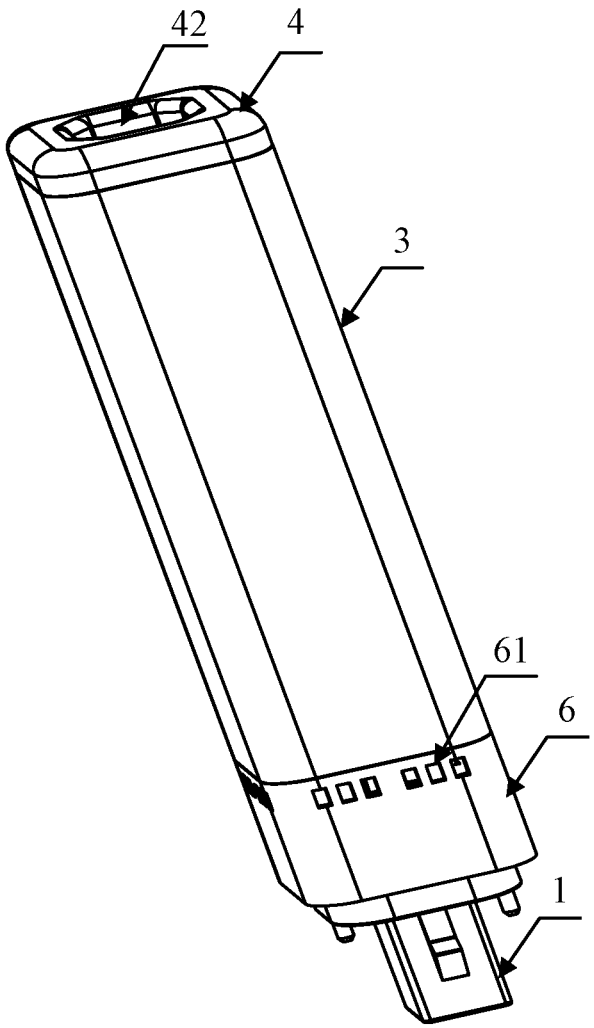
FIG. 2 is a schematic diagram of a first structure of a lighting lamp provided by an example of the present disclosure.
Figure 3:
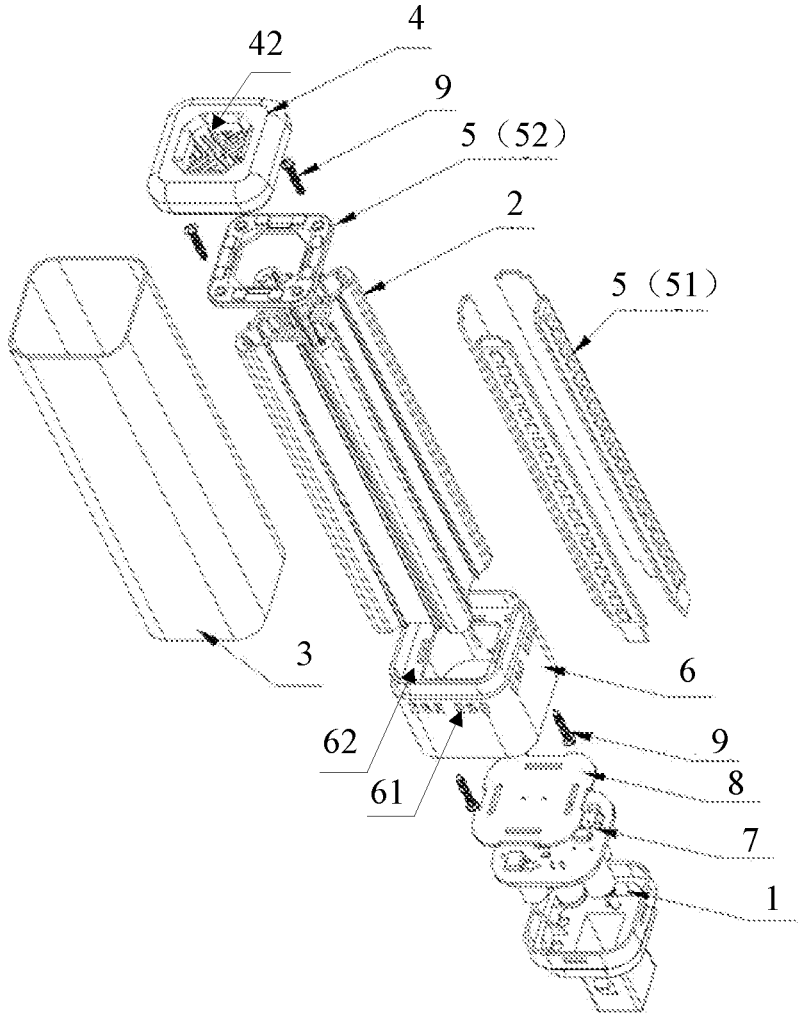
FIG. 3 is a schematic explosion structural diagram of a first structure of a lighting lamp provided by an example of the present disclosure.
Figure 4:
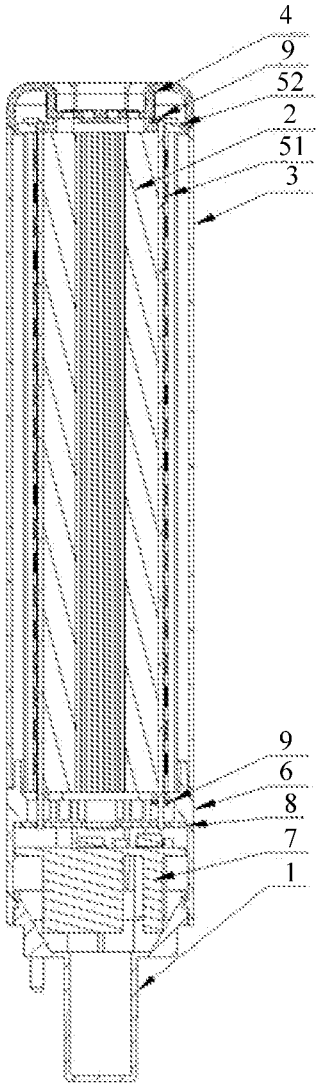
FIG. 4 is a cross-sectional diagram of a first structure of a lighting lamp provided by an example of the present disclosure.

As shown in FIG. 2 and FIG. 3, a lighting lamp provided by an example of the present disclosure includes an interface base 1; a radiator 2, a lower end of the radiator 2 being connected to the interface base 1; a side cover 3, disposed on a side of the radiator 2 and located on an outer periphery of the radiator 2; a top cover 4, disposed on an upper end of the radiator 2; and a light source assembly 5 for achieving light emission. The light source assembly 5 includes a side light source 51 installed between the radiator 2 and the side cover 3 and a top light source 52 installed between the radiator 2 and the top cover 4. By setting the lighting lamp in the above manner, the light emitting area of the lighting lamp can be increased and the light emitting effect can be improved.

Respective components of the lighting lamp can be constructed in a variety of ways. In the following, the example is taken to introduce the structures of the respective components in detail.

Figure 7:
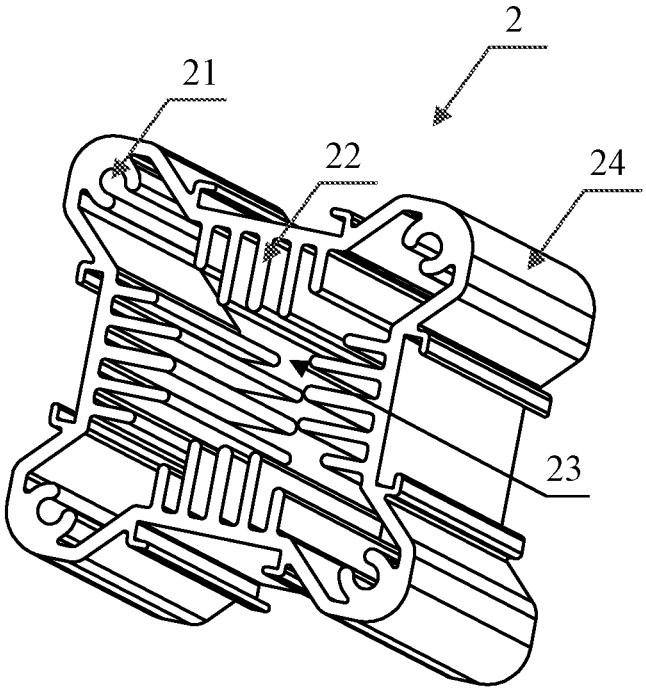
FIG. 7 is a schematic structural diagram of a radiator of a first structure of a lighting lamp provided by an example of the present disclosure.
Figure 10:
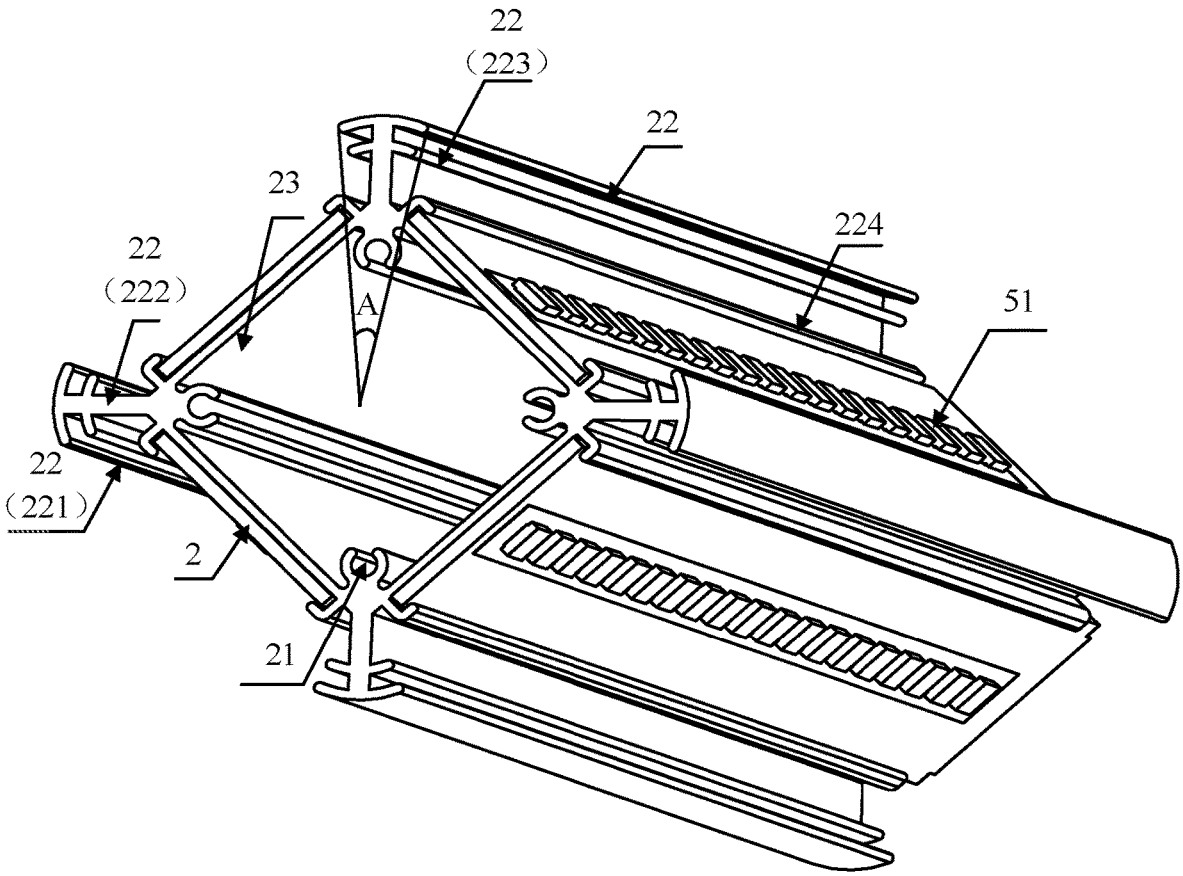
FIG. 10 is a schematic structural diagram of a radiator provided with a side light source in a third structure of a lighting lamp provided by an example of the present disclosure.
Figure 11:
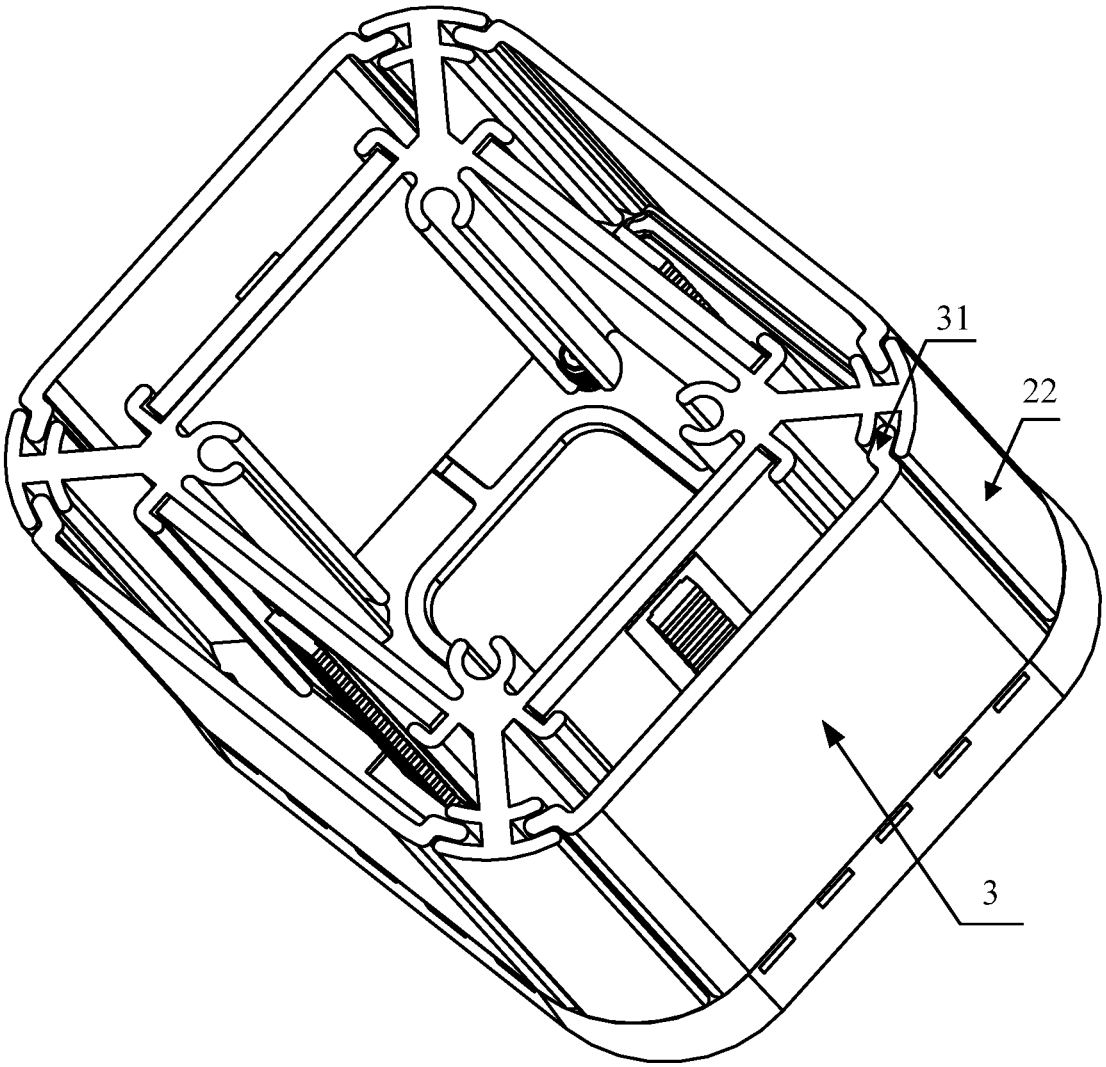
FIG. 11 is a schematic structural diagram of a third structure of a lighting lamp after removing a top cover and a top light source provided by an example of the present disclosure.

As shown in FIG. 3 to FIG. 7 and FIG. 10, the radiator 2 has a substantially tube-shaped structure, and the radiator 2 may be in a substantially rectangular tube shape or a circular tube shape. A middle portion of the radiator 2 is a through hole penetrating through two ends of the radiator 2, so as to configure a heat dissipation chamber 23 (as shown in FIGS. 7 and 10). Heat dissipation sheets 22 are provided on the radiator 2, and the heat dissipation sheets 22 may be located on the inner side of the radiator 2 or on the outer side of the radiator 2. In a case where the positions of the heat dissipation sheets 22 are different, the structure of the radiator 2 may be changed accordingly.

Taking a case that the radiator 2 is in a substantially rectangular tube shape as an example, as shown in FIGS. 3 to 7, in a case where a heat dissipation sheet 22 is provided on the inner side of the radiator 2, four corners 24 of the radiator 2 protrude outwards to form substantially arc-shaped corners 24. A fixing hole 21 is provided at an inner side of each corner 24 of the radiator 2, and the top light source 52 is fixed by a screw 9 disposed in the fixing hole 21. The heat dissipation sheet 22 is disposed on the inner side of the side wall between two adjacent corners 24 of the radiator 2. A plurality of heat dissipation sheets 22 may be provided on each side wall, and a width of each heat dissipation sheet 22 can be set according to requirements. In this case, the side cover 3 located on the outer periphery of the radiator 2 may be an in an integrated structure of a tube shape surrounding the radiator 2, so as to facilitate processing. The side cover 3 may be an existing PC cover to reduce costs.

As shown in FIG. 9 to FIG. 12, in a case where the radiator 2 is in a substantially rectangular tube shape and a heat dissipation sheet 22 is provided on the outer side of the radiator 2, the radiator 2 mainly comprises four side walls and a heat dissipation sheet 22, which is disposed between two adjacent side walls (located at a position of the corner 24 of the radiator 2) and protrudes outwards, and each corner 24 may be provided with one heat dissipation sheet 22. By disposing the heat dissipation sheet 22 on the outer side of the radiator 2, the cross-sectional area of the radiator 2 can be reduced, so that the side light source 51 can be relatively away from the side cover 3, thereby reducing the grainy sense of the product.

A fixing hole 21 is provided on the inner side of each corner 24 of the radiator 2, and the screw 9 passes through the top light source 52 and is screw-connected with the screw thread in the inner wall of the fixing hole 21. The heat dissipation sheet 22 and the side cover 3 forms a peripheral structure surrounding the radiator 2, the heat dissipation sheet 22 includes an arc-shaped heat dissipation plate 221 constituting the periphery structure and a heat conduction plate 222 connecting the radiator 2 and the arc-shaped heat dissipation plate 221. The material of the arc-shaped heat dissipation plate 221 and the material of the heat conduction plate 222 may be a metal material that can conduct heat easily, such as aluminum. An angle A formed by two sides of the arc-shaped heat dissipation plate 221 and a center line of the radiator 2 is less than 5 degrees, so as to reduce the obstruction of the arc-shaped heat dissipation plate 221 to the light emitted from the side light source 51.

In this case, a side cover 3 is provided between two adjacent arc-shaped heat dissipation plates 221. The two ends of the side cover 3 may be provided with bent portions 31 bent toward the radiator 2, and the heat conduction plate 222 is provided with a card plate 223 that cooperates with the arc-shaped heat dissipation plate 221. The transition between the arc-shaped heat dissipation plate 221 and the side cover 3 is achieved by inserting the bent portion 31 of the side cover 3 between the card plate 223 and the arc-shaped heat dissipation plate 221. The side cover 3 may also be an existing PC cover.

No matter how the radiator 2 is set, the side light source 51 is fixed on an outer side of the side wall between two adjacent corners 24 of the radiator 2, and a side light source 51 is provided on each side wall of the radiator 2 to achieve to emit light around. The side light source 51 includes a base substrate provided with lamp beads. The base substrate may be a substrate, and may also be other types of circuit boards or flexible circuit boards. A slot 224 (as shown in FIG. 10) may be provided on the outer side of the side wall of the radiator 2, and the base substrate is inserted in the slot 224.

The top light source 52 is in a substantially annular shape, and a middle portion of the top light source 52 comprises a through hole. The top light source 52 includes an insulating plate that is in a substantially annular shape and a base substrate that is stacked on the insulating plate and provided with lamp beads. The insulating plate is provided to meet the creepage distance and electrical clearance, and has a heat dissipation function. The insulating plate is fixed in the fixing hole 21 of the corner 24 of the radiator 2 by the screws 9, for example, and the base substrate is attached to the insulating plate by means of bonding or the like. The base substrate may be in an annular shape or an arcuate shape. In a case where the base substrate has an arcuate shape, a plurality of base substrates may be provided on the insulating plate.

The cross-sectional area of the through hole in the middle portion of the insulating plate may be slightly larger than the cross-sectional area of the through hole in the middle portion of the radiator 2. After the top light source 52 is installed, the inner side of the insulating plate can abut against the upper end of the side wall of the radiator 2 and be supported by the corner 24 (or the heat dissipation sheet 22 on the outer side) of the radiator 2 to improve the fixation firmness of the insulating plate.

Figure 5:
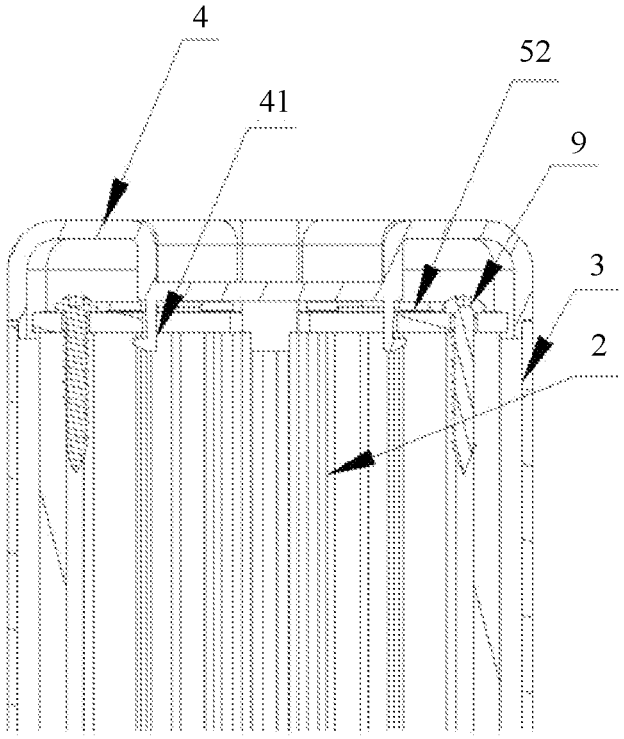
FIG. 5 is a partial schematic diagram of an upper portion of FIG. 4.
Figure 6:
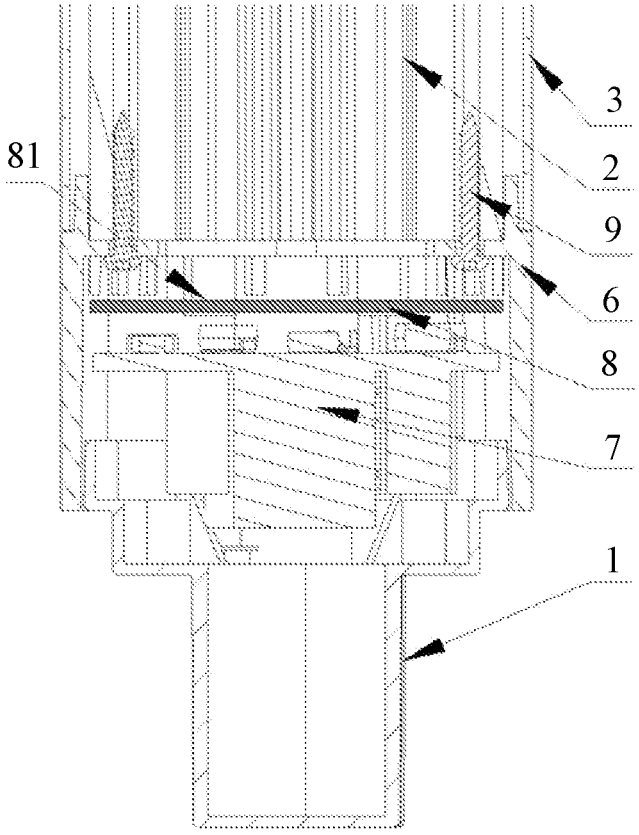
FIG. 6 is a partial schematic diagram of a lower portion of FIG. 4.

The middle portion of the top cover 4 is also provided with a through hole to form an air outlet 42. The cross-sectional area of the through hole of the top cover 4 may be slightly smaller than the cross-sectional area of the through hole of the insulating plate. In a case of installing the top cover 4, the outer side of the top cover 4 is fixed to the side cover 3, and the inner side of the top cover 4 is fixed to the insulating plate by a snap-fit component 41 (as shown in FIG. 5). The air outlet 42 of the top cover 4 may be provided with a grid to prevent from being cut or burned during installation and use. The material of the top cover 4 may be the same as or different from the material of the side cover 3, and may be selected according to requirements.

Figure 8:
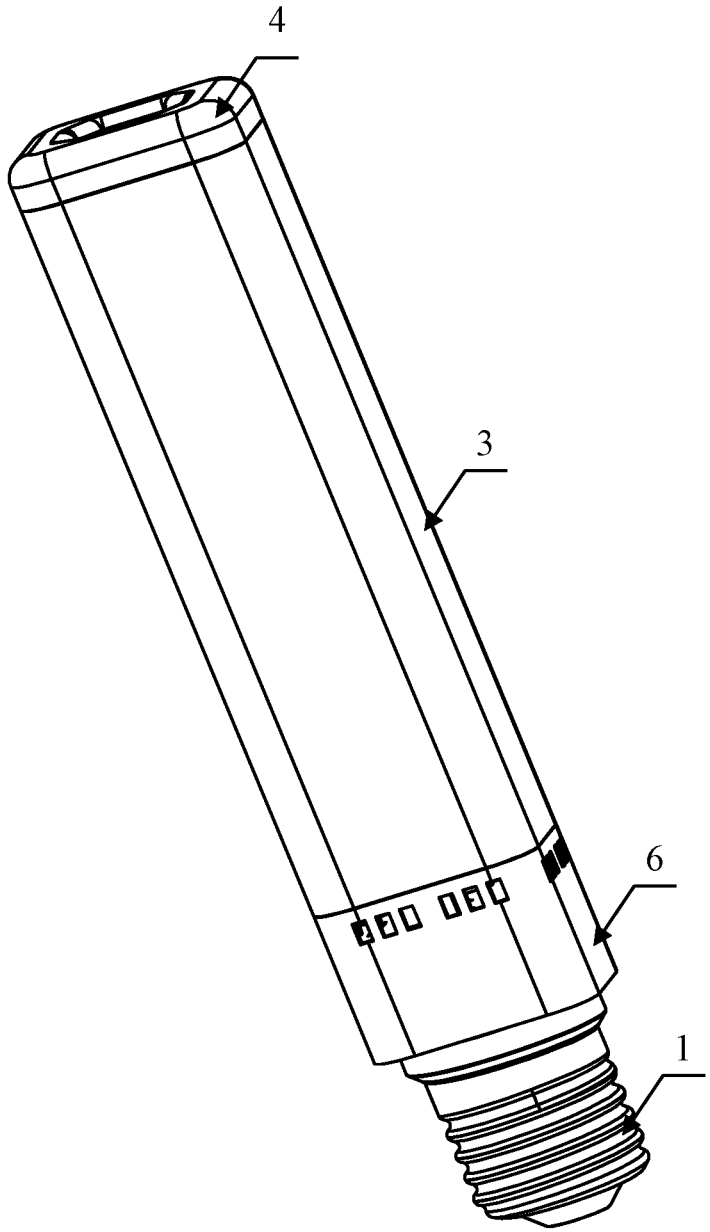
FIG. 8 is a schematic diagram of a second structure of a lighting lamp provided by an example of the present disclosure.
Figure 9:
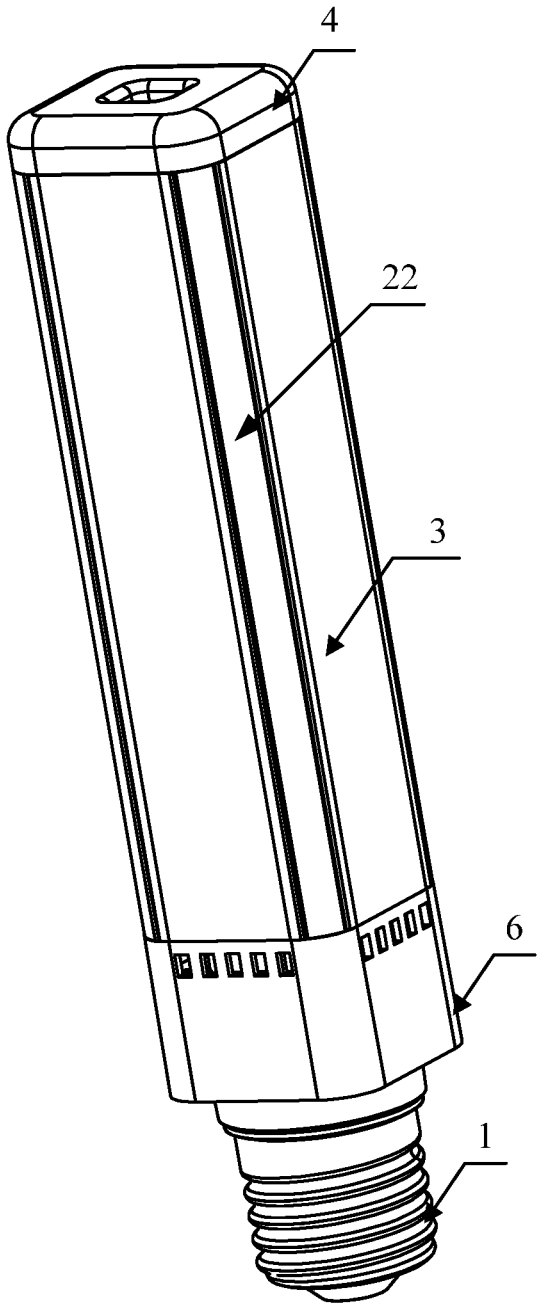
FIG. 9 is a schematic diagram of a third structure of a lighting lamp provided by an example of the present disclosure.
Figure 12:
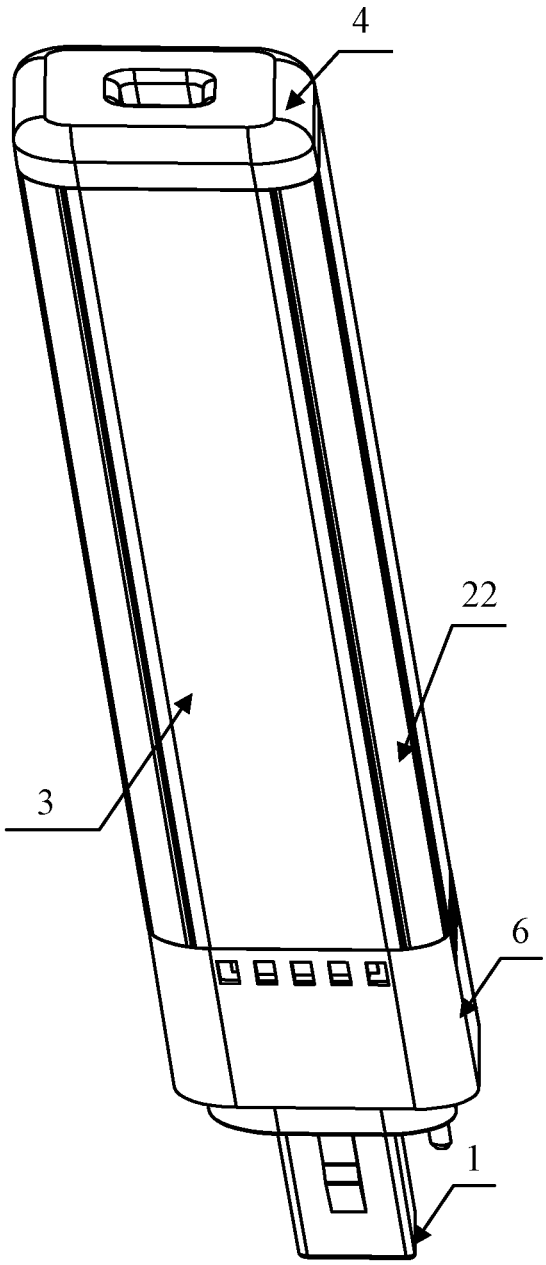
FIG. 12 is a schematic diagram of a fourth structure of a lighting lamp provided by an example of the present disclosure.

The interface base 1 may be a G24 interface base 1 (as shown in FIG. 2 and FIG. 12), or an E27 interface base 1 (as shown in FIG. 8 and FIG. 9). The G24 interface base 1 and the E27 interface base 1 are the same as the existing G24 interface base and the existing E27 interface base, respectively, and are not described here.

The radiator 2 is connected to the interface base 1 through a base cover 6. The base cover 6 has a hollow structure, and an air inlet 61 is provided on a side wall of the base cover 6. The side wall of the base cover 6 abuts against the side cover 3. The side wall of the base cover 6 is provided with a protrusion platform 62 for supporting the radiator 2. The radiator 2 is fixed to the base cover 6 by a screws 9 provided in the protrusion platform 62.

The base cover 6 is provided with a driving power source 7 and an adapter plate 8 for isolating the radiator 2 from the driving power source 7. The adapter plate 8 is an entire plate provided in the base cover 6 to reduce the thermal influence of the light source assembly 5 on the driving power source 7, thereby ensuring a long service life of the driving power source 7. A welding surface 81 is provided on the adapter plate 8. The base substrate of the side light source 51 can pass through the protrusion platform 62 of the base cover 6. The side light source 51 is welded to the adapter plate 8 to achieve electrical connection between the side light source 51 and the driving power source 7.

Figure 13:
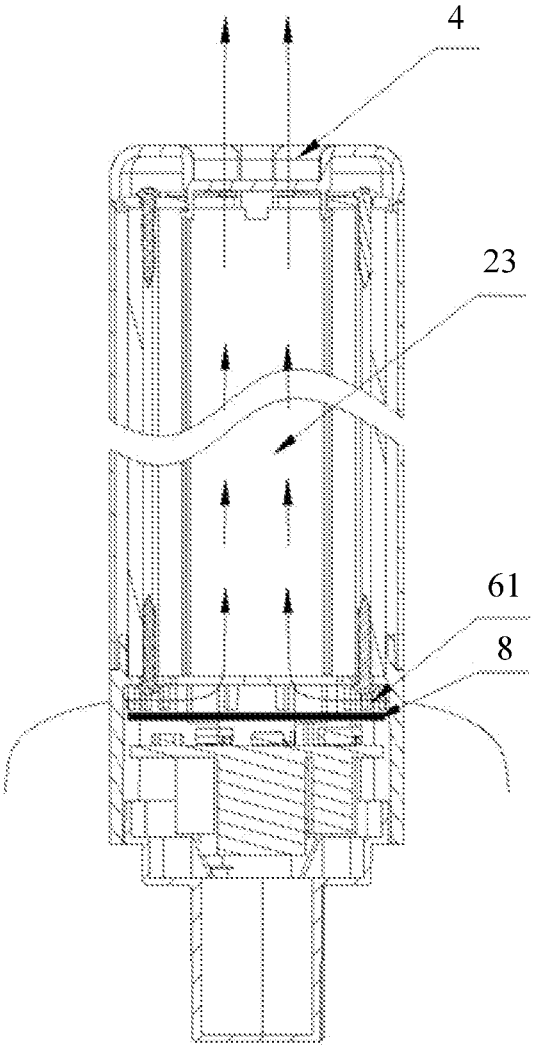
FIG. 13 is a schematic diagram of airflow flowing provided by an example of the present disclosure.

In a case where the adapter plate 8 is provided in the base cover 6, the air inlet 61 on the base cover 6 may be located above the adapter plate 8, so as to be able to communicate with the heat dissipation chamber 23 and the outside. As shown in FIG. 13, the base cover 6, the adapter plate 8, the radiator 2, and the top cover 4 cooperate to form an independent air duct that is used to circulate heat dissipation air from the heat dissipation chamber 23 (no air flows between the radiator 2 and the side cover 3).

The lighting lamp, which is designed in the above manner, has characteristics of a simple structure, low cost, and convenient assembly; the lamp beads of the top light source 52 and the lamp beads of the side light source 51 are located in closed spaces, thereby preventing dust or mosquitoes from affecting the light emission effect; within a limited size, the surface area of the radiator 2 is increased by reasonably distributing the heat dissipation sheets 22, and the heat dissipation of the light source assembly 5 is accelerated, so as to achieve the application of small size and high power.

Examples of the present disclosure provide a lighting lamp, and this lighting lamp can be used to solve a problem that a light emitting area of a lighting lamp is small.

The examples of the present disclosure adopt the following technical solutions.

An example of the present disclosure provides a lighting lamp, and the lighting lamp comprises: an interface base; a radiator, a lower end of the radiator being connected to the interface base; a side cover, disposed on a side of the radiator and located on an outer periphery of the radiator; a top cover, disposed on an upper end of the radiator; and a light source assembly, comprising a side light source installed between the radiator and the side cover and a top light source installed between the radiator and the top cover.

Optionally, the top light source is in an annular shape, and an inner side of the top light source abuts against an upper end of a side wall of the radiator.

Optionally, each corner of the radiator protrudes outwards, a fixing hole for fixing the top light source is provided at the each corner, and the top light source is supported at a protruding portion of the each corner.

Optionally, the top light source comprises an insulating plate that is in an annular shape and is fixed on the radiator and a base substrate that is disposed on the insulating plate and is provided with lamp beads.

Optionally, a middle portion of the radiator is configured as a heat dissipation chamber, an air outlet is provided at a portion of the top cover above the heat dissipation chamber, and an inner side of the top cover abuts against the top light source.

Optionally, a heat dissipation sheet is provided on an inner side of the side wall of the radiator, and the side cover forms a peripheral structure surrounding the radiator; or a heat dissipation sheet is provided on an outer side of the side wall of the radiator and at a position of the each corner, the heat dissipation sheet and the side cover form a peripheral structure surrounding the radiator.

Optionally, in a case where the side cover forms the peripheral structure surrounding the radiator, the side cover is in an integrated structure of a tube shape.

Optionally, in a case where the heat dissipation sheet and the side cover form the peripheral structure surrounding the radiator, the heat dissipation sheet comprises an arc-shaped heat dissipation plate constituting the peripheral structure and a heat conduction plate connecting the radiator and the arc-shaped heat dissipation plate.

Optionally, the radiator is in a rectangular tube shape, and four corners of the radiator are provided with heat dissipation sheets, respectively, and an angle formed by two sides of the arc-shaped heat dissipation plate and a center line of the radiator is less than 5 degrees.

Optionally, the radiator is connected to the interface base through a base cover that is hollow, the base cover is provided with a driving power source and an adapter plate that isolates the radiator and the driving power source, and an air inlet is provided on a side wall of the base cover above the adapter plate.

The above at least one technical solution adopted in the examples of the present disclosure can achieve the following beneficial effects.

In addition to providing the side light source on the side of the radiator, the top light source is also provided on an upper end of the radiator. In this way, in addition to emitting light at the side of the radiator, light can also be emitted at the upper end of the radiator, which can effectively increase the light emitting area.

The present disclosure also provides a method of manufacturing a lighting lamp. The method may include: providing an interface base; connecting the interface base to a lower end of a radiator; disposing a side cover on a side of the radiator where the side cover is located on an outer periphery of the radiator; disposing a top cover on an upper end of the radiator; and providing a light source assembly that may include a side light source installed between the radiator and the side cover, and a top light source installed between the radiator and the top cover.

In the method, the top light source may include an annular shape, and an inner side of the top light source may abut against an upper end of a side wall of the radiator.

The method may also include providing each corner of the radiator that protrudes outwards, providing a fixing hole for fixing the top light source at each corner, and supporting the top light source at a protruding portion of each corner.

In the method, the top light source may include an insulating plate that comprises an annular shape and is fixed on the radiator, and a base substrate that is disposed on the insulating plate and is provided with lamp beads.

The method may also include configuring a middle portion of the radiator as a heat dissipation chamber, providing an air outlet at a portion of the top cover above the heat dissipation chamber, and providing an inner side of the top cover that abuts against the top light source.

The method may also include providing a heat dissipation sheet on an inner side of the side wall of the radiator, and providing the side cover that forms a peripheral structure surrounding the radiator. Alternatively, the method may include providing a heat dissipation sheet on an outer side of the side wall of the radiator and at a position of each corner, and providing the heat dissipation sheet and the side cover to form a peripheral structure surrounding the radiator.

In the method, in a case where the side cover forms the peripheral structure surrounding the radiator, the side cover may include an integrated structure of a tube shape.

In the method, in a case where the heat dissipation sheet and the side cover form the peripheral structure surrounding the radiator, the heat dissipation sheet may include: an arc-shaped heat dissipation plate constituting the peripheral structure, and a heat conduction plate connecting the radiator and the arc-shaped heat dissipation plate.

The method may include providing the radiator that comprises a rectangular tube shape, providing four corners of the radiator with heat dissipation sheets, and providing an angle that is formed by two sides of the arc-shaped heat dissipation plate where a center line of the radiator may be less than 5 degrees.

The method may also include connecting the radiator to the interface base through a base cover that is hollow, providing the base cover with a driving power source and providing an adapter plate that isolates the radiator and the driving power source, and providing an air inlet on a side wall of the base cover above the adapter plate.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

What have been described above are only examples of the present disclosure and is not intended to limit the present disclosure. It is apparent to those skilled in the art that various modifications and variations can be made based on the present disclosure. Any modifications, equivalent replacements, or improvements made within the spirit and principle of the present disclosure shall be included in the scope of claims of the present disclosure.

What is claimed is:

1. A lighting lamp, comprising:

an interface base;

a radiator wherein a lower end of the radiator is connected to the interface base;

a side cover that is disposed on a side of the radiator and is located on an outer periphery of the radiator;

a top cover that is disposed on an upper end of the radiator;

a light source assembly that comprises a side light source installed between the radiator and the side cover, and a top light source installed between the radiator and the top cover; and a first heat dissipation sheet provided on an outer side of a side wall of the radiator and at a position of each corner of the radiator, wherein the first heat dissipation sheet and the side cover form a peripheral structure surrounding the radiator;

wherein in a case where the first heat dissipation sheet and the side cover form the peripheral structure surrounding the radiator, the first heat dissipation sheet comprises:

an arc-shaped heat dissipation plate constituting the peripheral structure, and a heat conduction plate connecting the radiator and the arc-shaped heat dissipation plate, wherein the heat conduction plate is provided with a card plate cooperating with the arc-shaped heat dissipation plate.

2. The lighting lamp according to claim 1, wherein the top light source comprises an annular shape, and an inner side of the top light source abuts against an upper end of the side wall of the radiator.

3. The lighting lamp according to claim 2, wherein:

each corner of the radiator protrudes outwards, a fixing hole for fixing the top light source is provided at each corner, and the top light source is supported at a protruding portion of each corner.

4. The lighting lamp according to claim 2, wherein the top light source comprises:

an insulating plate that comprises an annular shape and is fixed on the radiator, and a base substrate that is disposed on the insulating plate and is provided with lamp beads.

5. The lighting lamp according to claim 2, wherein:

a middle portion of the radiator is configured as a heat dissipation chamber, an air outlet is provided at a portion of the top cover above the heat dissipation chamber, and an inner side of the top cover abuts against the top light source.

6. The lighting lamp according to claim 5, wherein:

a second heat dissipation sheet is provided on an inner side of the side wall of the radiator, and the side cover forms the peripheral structure surrounding the radiator.

7. The lighting lamp according to claim 6, wherein, in a case where the side cover forms the peripheral structure surrounding the radiator, the side cover comprises an integrated structure of a tube shape.

8. The lighting lamp according to claim 1, wherein:

the radiator comprises a rectangular tube shape, four corners of the radiator are provided with first heat dissipation sheets, and an angle formed by two sides of the arc-shaped heat dissipation plate and a center line of the radiator is less than 5 degrees.

9. The lighting lamp according to claim 1, wherein:

the radiator is connected to the interface base through a base cover that is hollow, the base cover is provided with a driving power source and an adapter plate that isolates the radiator and the driving power source, and an air inlet is provided on a side wall of the base cover above the adapter plate.

10. A method of manufacturing a lighting lamp, comprising:

providing an interface base;

connecting the interface base to a lower end of a radiator;

disposing a side cover on a side of the radiator wherein the side cover is located on an outer periphery of the radiator;

disposing a top cover on an upper end of the radiator; and providing a light source assembly that comprises a side light source installed between the radiator and the side cover, and a top light source installed between the radiator and the top cover; and providing a first heat dissipation sheet on an outer side of a side wall of the radiator and at a position of each corner of the radiator, wherein the first heat dissipation sheet and the side cover form a peripheral structure surrounding the radiator;

wherein in a case where the first heat dissipation sheet and the side cover form the peripheral structure surrounding the radiator, the first heat dissipation sheet comprises:

an arc-shaped heat dissipation plate constituting the peripheral structure, and a heat conduction plate connecting the radiator and the arc-shaped heat dissipation plate; and providing the heat conduction plate with a card plate cooperating with the arc-shaped heat dissipation plate.

11. The method according to claim 10, wherein the top light source comprises an annular shape, and an inner side of the top light source abuts against an upper end of the side wall of the radiator.

12. The method according to claim 11, further comprising:

providing each corner of the radiator that protrudes outwards, providing a fixing hole for fixing the top light source at each corner, and supporting the top light source at a protruding portion of each corner.

13. The method according to claim 11, wherein the top light source comprises:

an insulating plate that comprises an annular shape and is fixed on the radiator, and a base substrate that is disposed on the insulating plate and is provided with lamp beads.

14. The method according to claim 11, further comprising:

configuring a middle portion of the radiator as a heat dissipation chamber, providing an air outlet at a portion of the top cover above the heat dissipation chamber, and providing an inner side of the top cover that abuts against the top light source.

15. The method according to claim 14, further comprising:

providing a second heat dissipation sheet on an inner side of the side wall of the radiator, and providing the side cover that forms the peripheral structure surrounding the radiator.

16. The method according to claim 15, wherein, in a case where the side cover forms the peripheral structure surrounding the radiator, the side cover comprises an integrated structure of a tube shape.

17. The method according to claim 10, further comprising:

providing the radiator that comprises a rectangular tube shape, providing four corners of the radiator with first heat dissipation sheets, and providing an angle that is formed by two sides of the arc-shaped heat dissipation plate wherein a center line of the radiator is less than 5 degrees.

18. The method according to claim 10, further comprising:

connecting the radiator to the interface base through a base cover that is hollow, providing the base cover with a driving power source and providing an adapter plate that isolates the radiator and the driving power source, and providing an air inlet on a side wall of the base cover above the adapter plate.

19. The lighting lamp according to claim 1, wherein an acute angle is defined by two sides of the arc-shaped heat dissipation plate.

20. The method according to claim 10, further comprising:

providing an acute angle defined by two sides of the arc-shaped heat dissipation plate.

* * * * *